US007877049B2

(12) United States Patent
Ikeda

(10) Patent No.: US 7,877,049 B2
(45) Date of Patent: Jan. 25, 2011

(54) IMAGE FORMING APPARATUS

(75) Inventor: Yuichi Ikeda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 657 days.

(21) Appl. No.: 11/766,600

(22) Filed: Jun. 21, 2007

(65) Prior Publication Data

US 2007/0297835 A1 Dec. 27, 2007

(30) Foreign Application Priority Data

Jun. 26, 2006 (JP) ..... 2006-175566

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS 6,055,391 A * 4/2000 Jackson et al. ..... 399/91
2005/0084275 A1 * 4/2005 Maeyama et al. ..... 399/45

FOREIGN PATENT DOCUMENTS

JP 10-288921 A 10/1998
JP 11-065315 A 3/1999
JP 2002283662 A * 10/2002
JP 2003-057908 A 2/2003
JP 2003-084505 A 3/2003
JP 2004-029525 A 1/2004

* cited by examiner

*Primary Examiner*—Constantine Hannaher
(74) *Attorney, Agent, or Firm*—Canon U.S.A., Inc. I.P. Division

(57) ABSTRACT

An image forming apparatus includes a vibration detecting sensor. If the vibration detecting sensor detects a vibration at or above a defined level, a toner image for detection is formed, and image forming conditions are controlled based on detection results of the formed toner image.

3 Claims, 14 Drawing Sheets

IMAGE FORMING APPARATUS

BACKGROUND OF THE INVENTION

1. Field of the Invention

The present invention relates to an electrostatic or electrophotographic image forming apparatus.

2. Description of the Related Art

An intermediate transfer type image forming apparatus shown in FIG. 8 is an example of a color image forming apparatus serving as a photocopier or a printer. The illustrated image forming apparatus sequentially superposes toner images formed in a plurality of image forming stations 10 that form toner images of respective colors, on an intermediate transfer member (intermediate transfer belt 31) and then transfers the toner images together onto a transfer material P.

As shown in FIG. 9, the intermediate transfer belt 31 is moved in the direction of an arrow by the rotation of an intermediate transfer belt drive roller 32. The drive input into the drive roller 32 is performed from a body drive or a stepping motor via a coupling 67 or a rocking gear. Registration patterns 65 and 66 formed on the intermediate transfer belt 31 by the image forming stations 10 are detected by a registration sensor unit 60. On the basis of the detection results, image adjustment is performed. The registration sensor unit 60 is positioned by positioning units 64 provided in a frame of an intermediate transfer unit 30, so as to be perpendicular to the height direction of the intermediate transfer belt 31 and the moving direction of images in a first transfer plane A.

The registration sensor unit 60 includes sensors 61 (registration sensors) disposed at predetermined positions in front of and behind the images. Each registration sensor 61 includes a light emitter 62 and a light receiver 63. Light emitted from the light emitter 62 is reflected by the intermediate transfer belt 31 and is then received by the light receiver 63. The parts that bear toner (registration patterns 65 and 66) reflect a smaller amount of light to the light receiver 63. The parts that do not bear toner reflect a larger amount of light to the light receiver 63. The registration patterns 65 and 66 are detected from the amount of reflected light that the light receiver 63 receives.

The amount of deviation of the start position of each subscanning and the inclination are detected by using the registration pattern 65. The amount of deviation of the start position of the main scanning and the overall magnification ratio are detected by using the registration pattern 66. On the basis of these data, the deviation of the timing of starting the image formation in the main scanning and the subscanning, the change in magnification ratio, the inclination of the image, and so forth are adjusted by image correction (hereinafter referred to as "registration correction" or "automatic registration"). See, for example, Japanese Patent Laid-Open No. 2004-029525.

This image adjustment (hereinafter referred to as "automatic registration mode") is performed, for example, when the image forming apparatus is turned on, at the restart after the clearance of a paper jam, and after a lapse of a predetermined time period from the power-on. Other than this automatic registration, for example, some image forming apparatuses form toner images for detection for performing density adjustment and execute density adjustment on the basis of these toner images for detection.

However, in the case of a conventional image forming apparatus, if anyone or anything bumps against the apparatus and causes a vibration during or after the automatic registration mode or the density adjustment, an image formation failure can occur. For example, if the image forming apparatus is substantially vibrated, an image cannot be formed at the target position, and density fluctuation occurs, and thereby an image formation failure occurs. In particular, if a vibration occurs during a full color image formation, in which images are superposed, and thereby the image forming position is deviated, an image formation failure such as color misregistration occurs.

SUMMARY OF THE INVENTION

An embodiment of the present invention is directed to an image forming apparatus capable of correcting an image forming condition without a user interaction in a case where a vibration to the apparatus has caused color misregistration.

According to an aspect of the present invention, an image forming apparatus includes an image forming portion, a correcting unit, a vibration detecting unit, and an executing unit. The image forming portion forms an image. The correcting unit forms a toner image for detection by using the image forming portion and performs correction of image forming conditions based on the toner image for detection. The vibration detecting unit detects a vibration of the image forming apparatus. The executing unit automatically executes correction of image forming conditions by using the correcting unit if the vibration detecting unit detects a vibration at or above a predetermined vibration level.

Further features of the present invention will become apparent from the following description of exemplary embodiments (with reference to the attached drawings).

DESCRIPTION OF THE EMBODIMENTS

Embodiment 1

Figure 1:
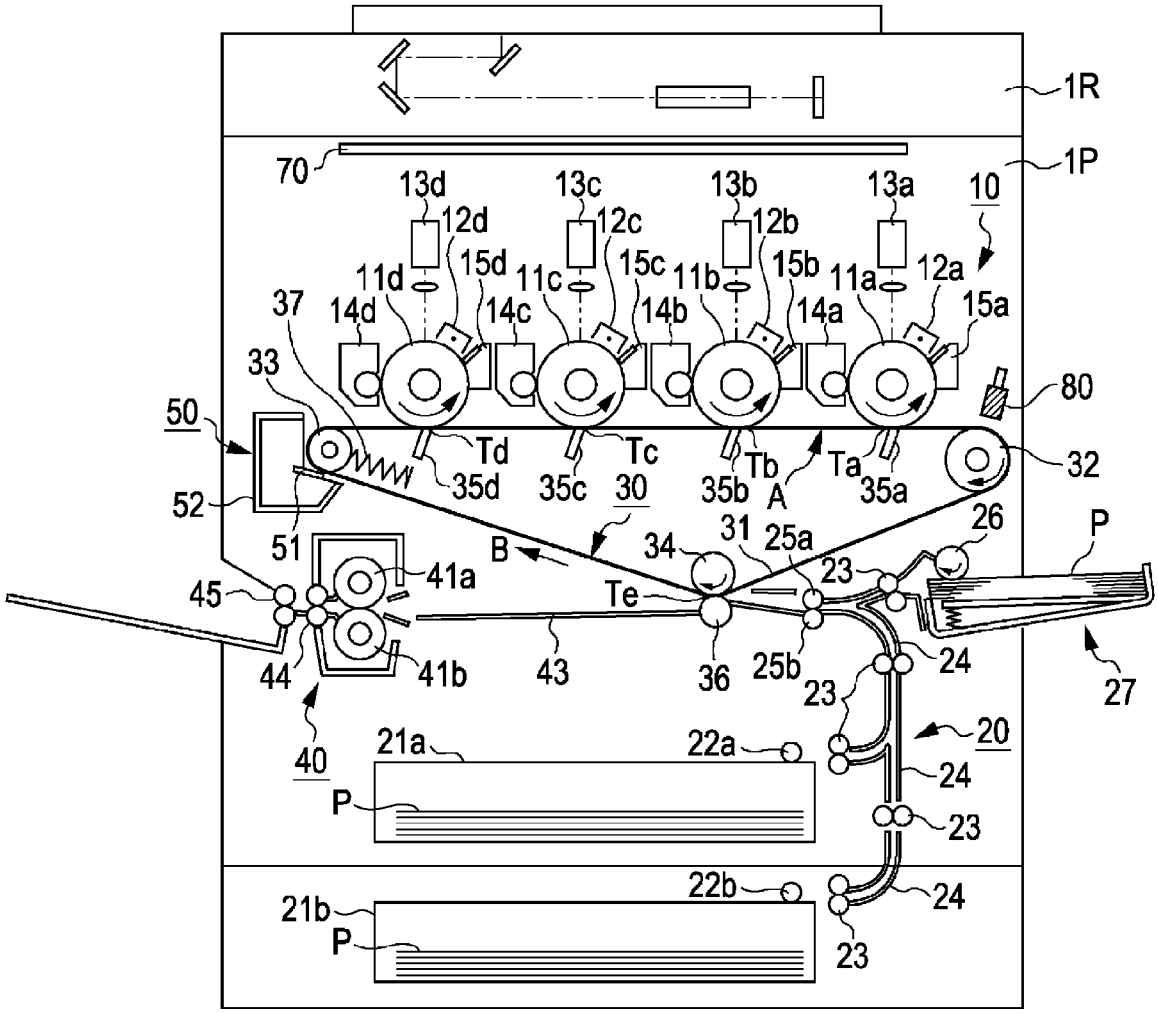
FIG. 1 illustrates an intermediate transfer type color image forming apparatus according to an embodiment.
Figure 2:
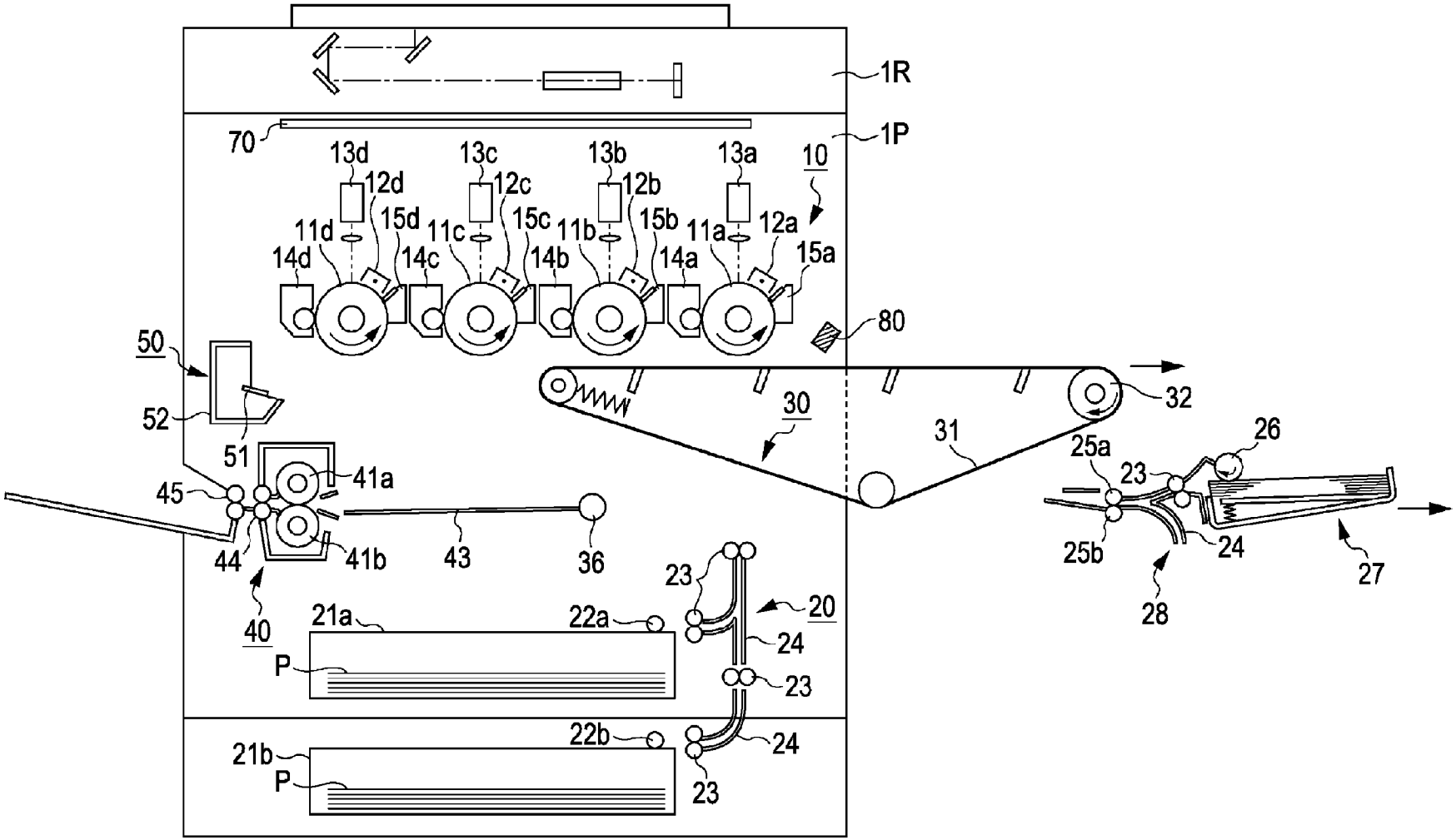
FIG. 2 illustrates the color image forming apparatus shown in FIG. 1 with an intermediate transfer belt unit drawn out.
Figure 3:
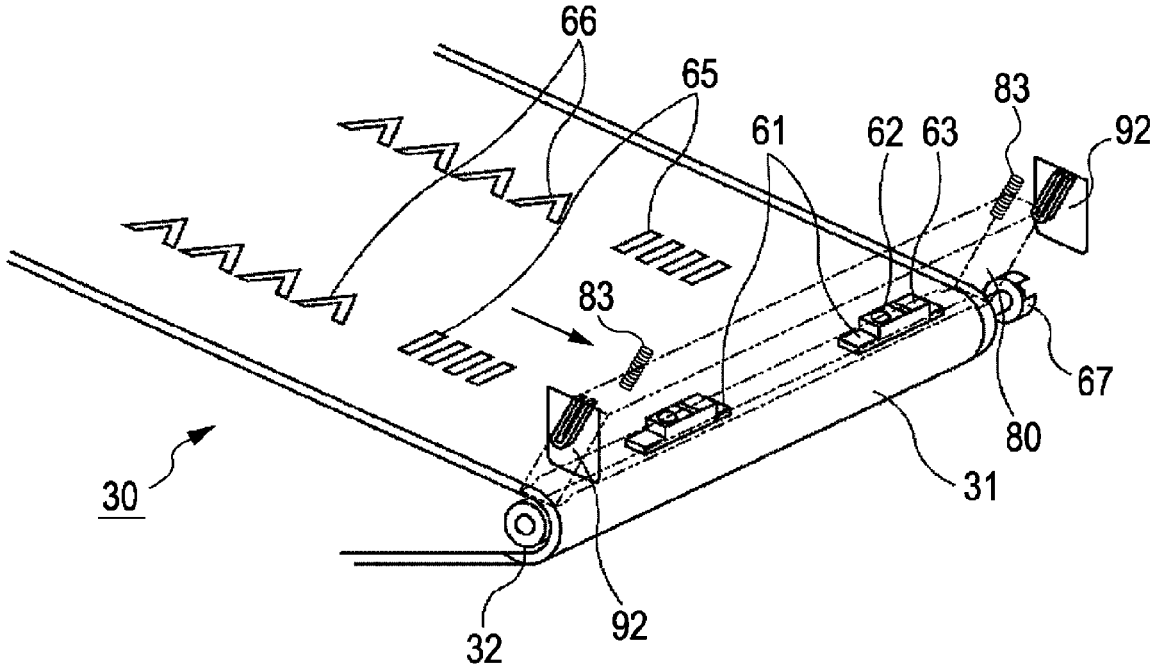
FIG. 3 illustrates a detection of toner images on an intermediate transfer member.
Figure 4:
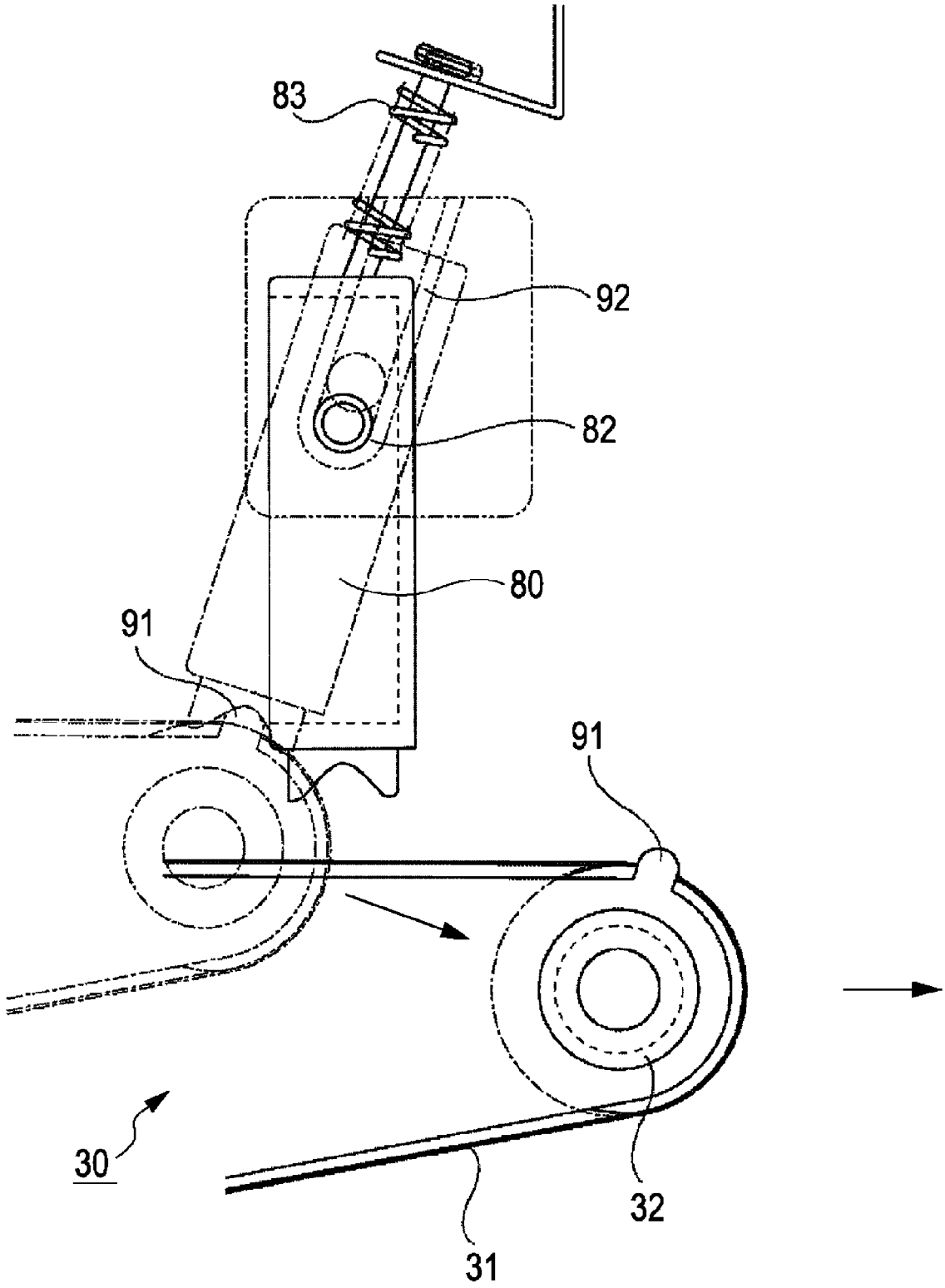
FIG. 4 illustrates the intermediate transfer belt unit drawn out.
Figure 5:
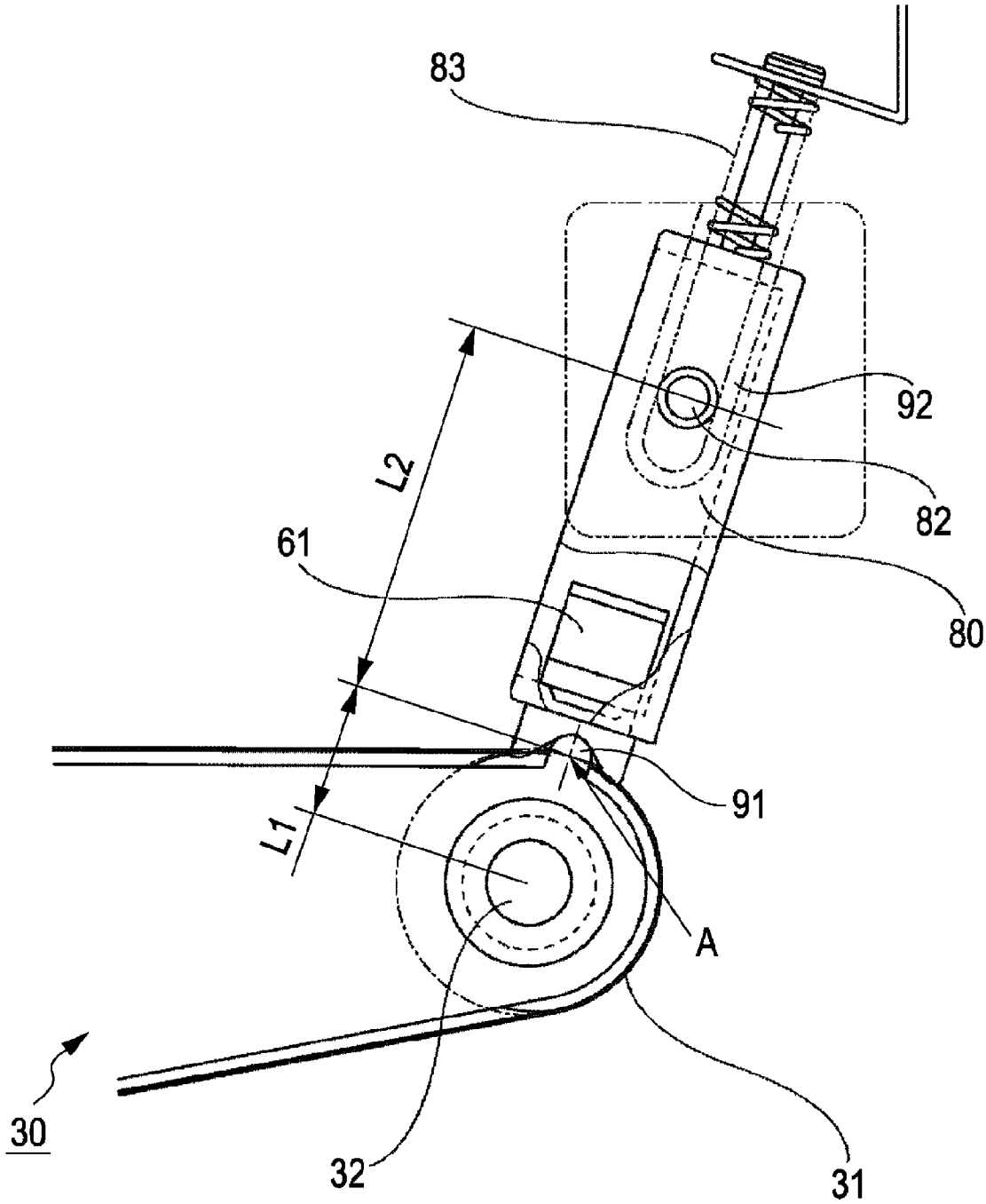
FIGS. 5 to 7 illustrate a detecting unit.
Figure 6:
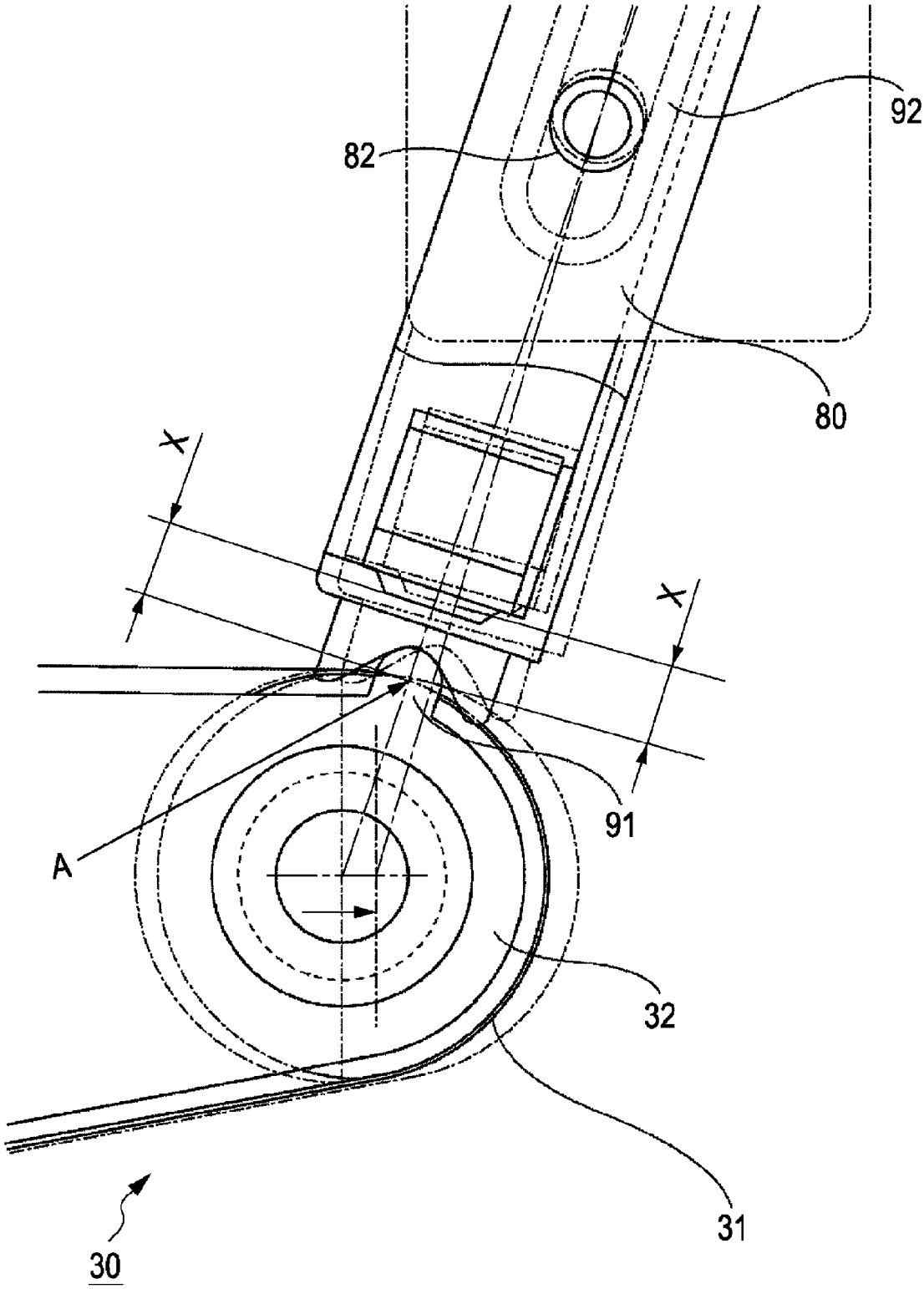
Figure 7:
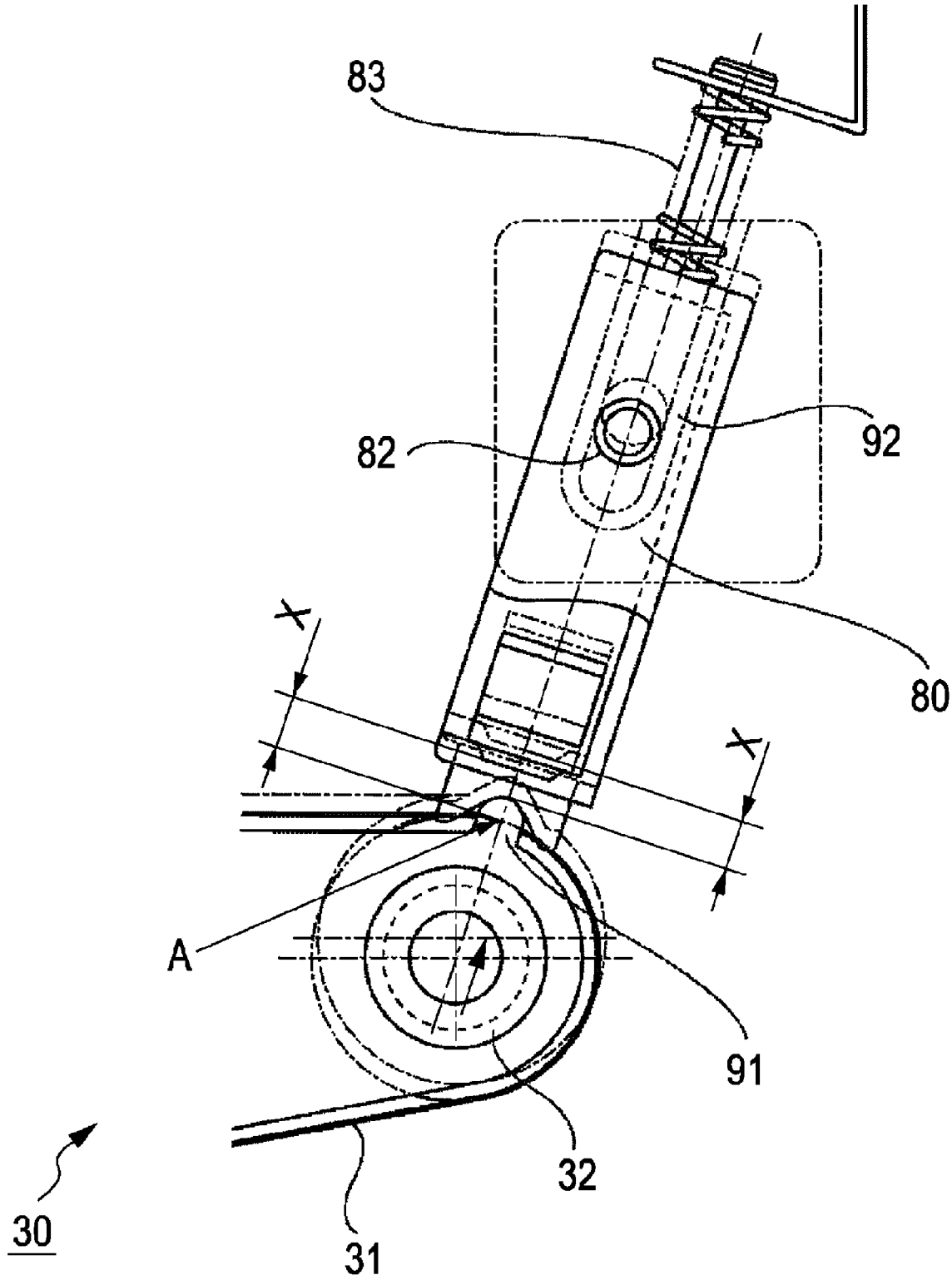
Figure 8:
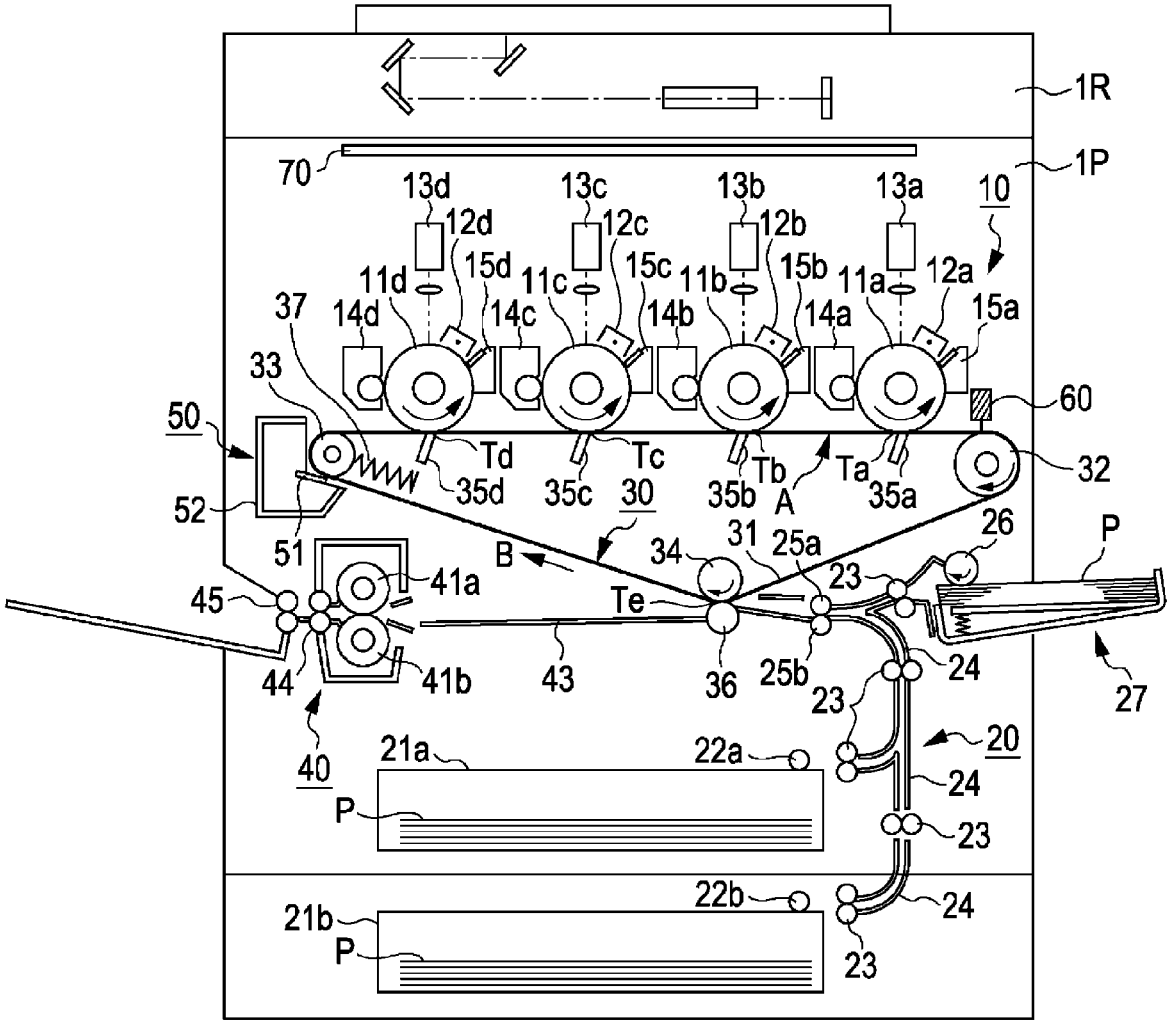
FIG. 8 illustrates the structure of a conventional intermediate transfer type color image forming apparatus.
Figure 9:
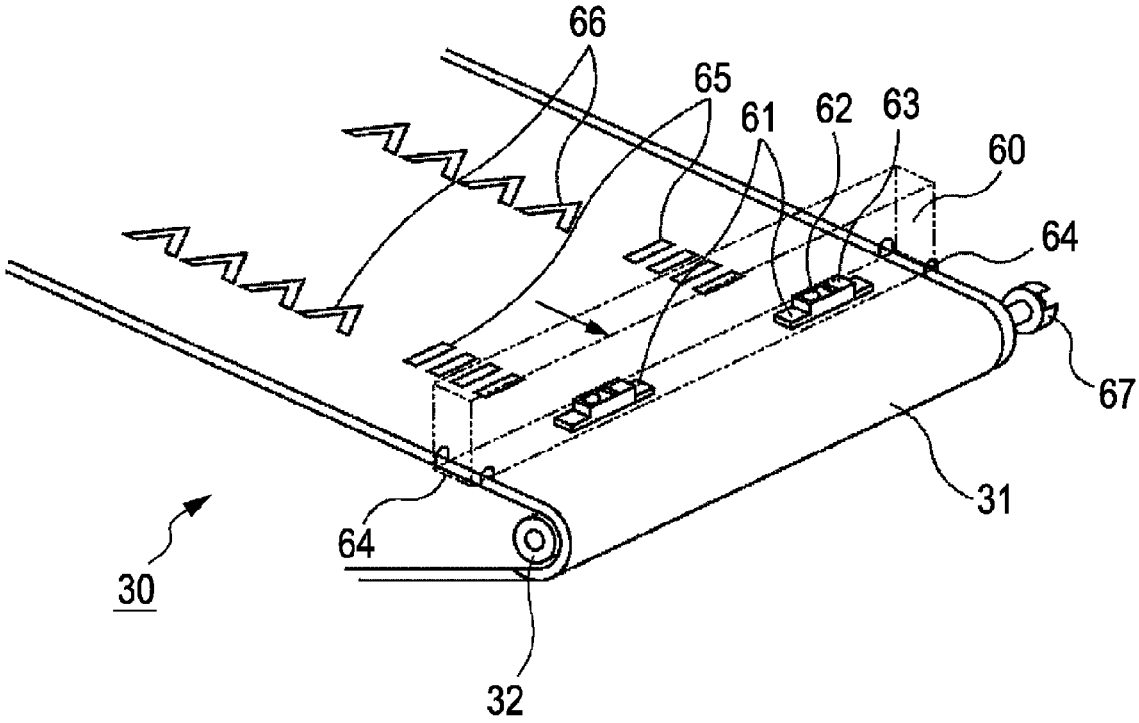
FIG. 9 PRIOR ART
FIG. 9 illustrates a conventional detection of toner images on an intermediate transfer member.

An embodiment of an image forming apparatus according to the present invention will now be described with reference to the drawings. FIG. 1 illustrates an intermediate transfer type color image forming apparatus according to an embodiment. FIG. 2 illustrates the color image forming apparatus shown in FIG. 1 with an intermediate transfer belt unit drawn out. FIG. 3 illustrates a detection of toner images on an intermediate transfer member. FIG. 4 illustrates the intermediate transfer belt unit drawn out. FIGS. 5 to 7 illustrate a detecting unit.

Image Forming Apparatus

As shown in FIG. 1, the intermediate transfer type color image forming apparatus according to an embodiment includes an image reading portion 1R and an image output portion 1P.

The image output portion 1P mainly includes an image forming portion 10 (including four stations 10*a*, 10*b*, 10*c*, and 10*d* that are provided in proximity in a row arrangement and have the same structure), a feed unit 20, an intermediate transfer unit 30, a fixing unit 40, and a control unit.

Each individual unit will be described in detail. The image forming portion 10 has the following structure. Photosensitive drums 11*a*, 11*b*, 11*c*, and 11*d* serving as image bearing members are pivotally supported at their centers and driven so as to rotate in the directions of arrows. First chargers 12*a*, 12*b*, 12*c*, and 12*d* serving as charging units are disposed so as to face the peripheries of the photosensitive drums 11*a* to 11*d*. In addition, optical systems 13*a*, 13*b*, 13*c*, and 13*d* serving as latent image forming units, and developing units 14*a*, 14*b*, 14*c*, and 14*d* are disposed. The first chargers 12*a* to 12*d* uniformly charge the surfaces of the photosensitive drums 11*a* to 11*d*. Next, the optical systems 13*a* to 13*d* expose the photosensitive drums 11*a* to 11*d* to rays, for example, laser beams modulated in accordance with record image signals, thereby forming electrostatic latent images thereon. In addition, the developing units 14*a* to 14*d*, which contain four colors (yellow, cyan, magenta, and black, respectively) of developers (toners), make the above electrostatic latent images visible. The images made visible are transferred onto an intermediate transfer belt 31 serving as an intermediate transfer member, in image transfer regions Ta, Tb, Tc, and Td. On the downstream sides of the image transfer regions Ta, Tb, Tc, and Td in the rotation directions of the photosensitive drums 11*a* to 11*d* are disposed cleaning units 15*a*, 15*b*, 15*c*, and 15*d*, which scrape residual toners off the photosensitive drums 11*a* to 11*d* to clean the surfaces of the drums. Through the above process, images are sequentially formed with respective toners.

The feed unit 20 includes cassettes 21*a* and 21*b*, a manual feed tray 27, pickup rollers 22*a*, 22*b* and 26, feed roller pairs 23, feed guides 24, and registration rollers 25*a* and 25*b*. The cassettes 21*a* and 21*b* and the manual feed tray 27 contain transfer materials P. The pickup rollers 22*a*, 22*b* and 26 send the transfer materials P one at a time out of the cassettes or the manual feed tray. The transfer material P sent out by each pickup roller is conveyed to the registration rollers by the feed roller pairs 23 and the feed guides 24. The registration rollers 25*a* and 25*b* send out the transfer material P to a second transfer region Te in timed relationship with the image formation of the image forming portion 10.

The intermediate transfer unit 30 will be described. A drive roller 32 is an intermediate-transfer-member holding unit that transmits drive to the intermediate transfer belt 31. The intermediate transfer belt 31 is stretched around the drive roller 32, a tension roller 33 and a driven roller 34. Urged by a spring 37, the tension roller 33 gives an appropriate tension to the intermediate transfer belt 31. The driven roller 34 faces the second transfer region Te with the belt therebetween. Between the drive roller 32 and the tension roller 33 is formed the first transfer plane A. The drive roller 32 is a metal roller coated with a few millimeters thick (urethane or chloroprene) rubber so as not to slip relative to the belt. The drive roller 32 is supplied with drive via a coupling or a rocking gear so as to be rotated. As shown in FIG. 2, the intermediate transfer belt unit 30 can be taken out of the apparatus body, by drawing out a registration multiunit 28 to the right, for replacement of components such as the intermediate transfer belt 31. In the first transfer regions Ta to Td, where the photosensitive drums 11*a* to 11*d* face the intermediate transfer belt 31, and under the intermediate transfer belt 31 are disposed first transfer blades 35*a* to 35*d* serving as transfer units. A second transfer roller 36 is disposed so as to face the driven roller 34. The nip between the second transfer roller 36 and the intermediate transfer belt 31 forms the second transfer region Te. The second transfer roller 36 is pressed against the intermediate transfer belt 31 under an appropriate pressure. The intermediate transfer member, the first transfer blades, and the second transfer roller can be regarded as a transfer unit that transfers toner images formed on the photosensitive drums onto a recording material. In addition, on the intermediate transfer belt 31 on the downstream side of the second transfer region Te is disposed a cleaning unit 50 for cleaning the image forming surface of the intermediate transfer belt 31. The cleaning unit 50 includes a cleaner blade 51 (formed of, for example, polyurethane rubber) and a waste toner box 52 containing waste toner.

The fixing unit 40 includes a fixing roller 41*a* having a heat source such as a halogen heater thereinside, a roller 41*b* pressed against the roller 41*a* (the roller 41*b* can also have a heat source), and a guide 43 for guiding the transfer material P to the nip between the roller pair. The fixing unit 40 further includes an inner output roller pair 44 and an outer output roller pair 45. The transfer material P output from the roller pair 41*a* and 41*b* is guided out of the apparatus by the roller pairs 44 and 45. The control unit includes a control substrate 70 controlling the operations of the mechanisms in the above units, a motor drive substrate (not shown), and so forth.

Next, the operation of the apparatus will be described.

When an image-forming-operation starting signal is generated, first, the pickup roller 22*a* sends the transfer materials P one at a time out of the cassette 21*a*. Guided by the feed guides 24, the transfer material P is conveyed to the registration rollers 25*a* and 25*b* by the feed roller pairs 23. At this time, the registration rollers 25*a* and 25*b* are at rest, and the leading edge of the transfer material P comes into contact with the nip. Thereafter, the registration rollers 25*a* and 25*b* start to rotate in timed relationship with the start of the image formation by the image forming portion 10. The rotation timing of the registration rollers 25*a* and 25*b* is set so that the toner images first-transferred onto the intermediate transfer belt 31 from the image forming portion 10 and the transfer material P may just be registered with each other in the second transfer region Te.

On the other hand, in the image forming portion 10, when an image forming operation starting signal is generated, a toner image formed on the photosensitive drum 11*d* through the above-described process is first-transferred to the intermediate transfer belt 31 in the first transfer area Td by the first transfer charger 35*d*. The first-transferred toner image is conveyed to the next first transfer region Tc. An image is formed there with a delay by the time the toner image takes to be conveyed between the image forming stations, and the toner image is registered with and transferred onto the previous toner image. Thereafter, the same process is repeated. Thus, toner images of the four colors are first-transferred onto the intermediate transfer belt 31.

Thereafter, the transfer material P enters the second transfer region Te and comes into contact with the intermediate transfer belt 31, whereupon a high voltage is applied to the second transfer roller 36 in timed relationship with the passage of the transfer material P. The toner images of the four colors superposed on the intermediate transfer belt through the above-described process are transferred together onto the surface of the transfer material P. Thereafter, the transfer material P is accurately guided to the fixing roller nip by the conveyance guide 43. The toner images are fixed on the surface of the transfer material by the heat of the roller pairs 41*a* and 41*b* and the pressure of the nip. Thereafter, conveyed by the inner and outer output roller pairs 44 and 45, the transfer material is sent out of the apparatus body.

In the case of the formation of a monochrome image, a monochrome visible image is first-transferred onto the intermediate transfer belt 31 from a particular image forming station (for example, the most downstream image forming station 10*a* in the moving direction of the intermediate transfer belt), and then the same process as in the case of the formation of a full color image is performed so as to form a monochrome image.

In order to form a full color image, the images formed by the image forming stations 10*a* to 10*d* need to be superposed. For this purpose, adjustment for superposing the images is performed in advance before the image formation.

Registration Correction Control

Next, the registration correction will be described with reference to FIG. 3. The image forming apparatus has a registration sensor unit 80 serving as a detecting unit that detects registration patterns 65 and 66 formed by the image forming stations when the image forming apparatus enters the automatic registration mode. On the basis of the detection information of the registration sensor unit 80, the control unit gives feedback about the scanned image and performs the registration correction.

The intermediate transfer belt 31 is moved in the direction of an arrow by the rotation of the intermediate transfer belt drive roller 32. The drive input into the drive roller 32 is performed from a body drive or a stepping motor via a coupling 67 or a rocking gear. Registration patterns 65 and 66 formed on the intermediate transfer belt 31 by the image forming stations 10 are detected by the registration sensor unit 80. On the basis of the detection results, image adjustment is performed.

The registration sensor unit 80 includes sensors 61 (registration sensors) disposed at predetermined positions in front of and behind the images. Each registration sensor 61 includes a light emitter 62 and a light receiver 63. Light emitted from the light emitter 62 is reflected by the intermediate transfer belt 31 and is then received by the light receiver 63. The parts that bear toner (registration patterns 65 and 66) reflect a smaller amount of light to the light receiver 63. The parts that do not bear toner reflect a larger amount of light to the light receiver 63. The registration patterns 65 and 66 are detected from the amount of reflected light that the light receiver 63 receives.

The amount of deviation of the start position of each subscanning and the inclination are detected by using the registration pattern 65. The amount of deviation of the start position of the main scanning and the overall magnification ratio are detected by using the registration pattern 66. The control substrate 70 (shown in FIGS. 1 and 2) serving as a control unit controls image forming conditions on the basis of the data detected by the registration sensor unit 80. That is to say, the control substrate 70 corrects the deviation of the timing of starting the image formation in the main scanning and the subscanning, the change in magnification ratio, the inclination of the image, and so forth by image correction (hereinafter referred to as "registration correction" or "automatic registration"). Specifically, the control substrate 70 adjusts the timing of starting the latent image formation of each latent image forming unit and the position of each latent image forming unit, thereby adjusting the starting position of the latent image formation. Thus, images formed on the image bearing members are transferred to a predetermined target transfer position.

This image adjustment (hereinafter referred to as "registration detection control") is performed, for example, when the image forming apparatus is turned on, at the restart after the clearance of a paper jam, and after a lapse of a predetermined time period from the power-on.

FIG. 4 illustrates the intermediate transfer belt unit 30 drawn out. As shown in FIG. 4, the registration sensor unit 80 has engaging portions 82 at both ends thereof in the width direction of the transfer material P, and the engaging portions 82 are slidably held in guides 92. In addition, the registration sensor unit 80 has pressing units 83. The registration sensor unit 80 is urged by the pressing units 83 against positioning members 91 (positioning units) of the frame of the intermediate transfer belt unit 30 and is thereby positioned.

When the intermediate transfer belt unit 30 is drawn out, the registration sensor unit 80 is released from the pressure and remains in the apparatus body with the engaging portions 82 held in the guides 92.

In FIG. 5, the optical axis of the registration sensor 61 passes through the center of the shaft of the intermediate transfer belt drive roller 32. The registration sensor 61 thereby performs detection over the intermediate transfer belt 31 on the drive roller 32. The intermediate transfer belt 31 is stably wrapped around the drive roller 32 and is prevented from flapping.

The registration sensor unit 80 is positioned by the positioning members 91 of the intermediate transfer belt unit 30 and the engaging portions 82. Each positioning member 91 has a circular arc shape whose center is located substantially on the intermediate transfer belt surface. The positioning member 91 engages with the registration sensor unit 80, and thereby the registration sensor unit 80 can rotate around the center of the positioning member 91 (fulcrum A). Therefore, as shown in FIG. 6, if the positional relationship between the intermediate transfer belt drive roller 32 and the registration sensor unit 80 deviates, for example, due to a vibration of the drive roller 32, the registration sensor unit 80 follows the drive roller 32. Therefore, detection can be performed without changing the distance between the registration sensor 61 and the intermediate transfer belt 31. Thus, the positioning accuracy of the registration sensor 61 and the intermediate transfer belt 31 can be improved, and the displacement of the detection position of the registration sensor unit 80 due to a vibration of the drive roller 32 can be reduced.

Guided by the guide 92, the engaging portion 82 can slide toward the center of the shaft of the intermediate transfer belt drive roller 32. The fulcrum A of the positioning member 91, the engaging portion 82, and the center of the shaft of the drive roller 32 lie on the extended line of the optical axis of the registration sensor 61 facing the center of the drive shaft. Therefore, as shown in FIG. 7, if the shaft of the intermediate transfer belt drive roller 32 is displaced due to a vibration, the deviation of the optical axis of the registration sensor 61 can be reduced, and the deviation in distance between the registration sensor 61 and the intermediate transfer belt 31 can be reduced. When the distance from the center of the shaft of the drive roller 32 to the fulcrum A of the positioning member 91 is L1, and the distance from the fulcrum A of the positioning member 91 to the engaging portion 82 is L2, the displacement of the engaging portion 82 can be reduced to a negligible level by making L1 less than L2.

The positional relationship between the engaging portion 82, the guide 92, and the positioning member 91 is not limited to this. The engaging portion 82 and the guide 92 have only to be able to slide on the line passing through the registration sensor 61 and the positioning member 91 or parallel thereto.

As with the fulcrum A of the positioning member 91 and the engaging portion 82, the pressing unit 83 lies on the line passing through the center of the drive shaft of the drive roller 32 and the detection point of the registration sensor 61. Since the registration sensor unit 80 is always urged against the drive roller 32, the displacement of the registration sensor unit 80 can be reduced.

Vibration Detecting Sensor

Figure 10:
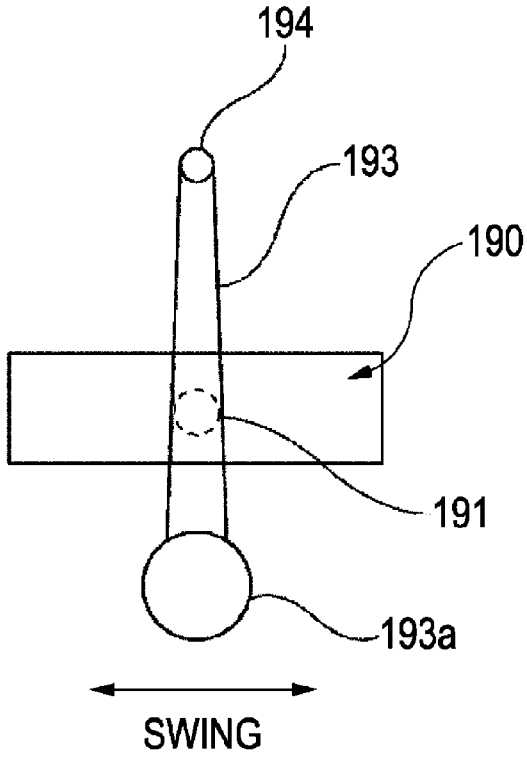
FIG. 10 is a side view of a vibration detecting sensor used in the image forming apparatus according to the embodiment.
Figure 11:
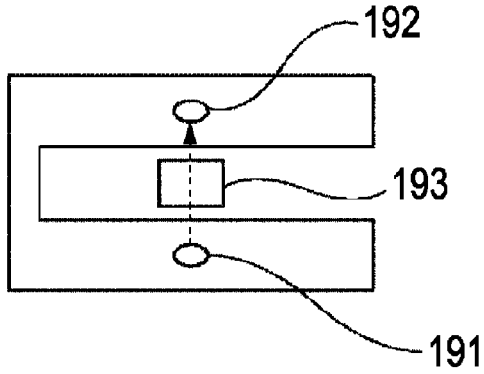
FIG. 11 is a sectional view of a sensor portion of the vibration detecting sensor used in the image forming apparatus according to the embodiment.

Next, the vibration detecting sensor 190 serving as a vibration detecting unit used in the image forming apparatus in this embodiment will be described with reference to FIGS. 10 to 14. As shown in FIGS. 10 and 11, the vibration detecting sensor 190 has a structure of a photo interrupter. FIG. 10 is a side view, and FIG. 11 is a sectional view of a sensor portion. As shown in FIGS. 10 and 11, the vibration detecting sensor 190 includes a photo interrupter including an LED 191 and a phototransistor 192, and an actuator 193 suspended from a fulcrum 194 so that it can swing from side to side. The actuator 193 has a weight 193*a* at the end opposite from the fulcrum 194.

Figure 12:
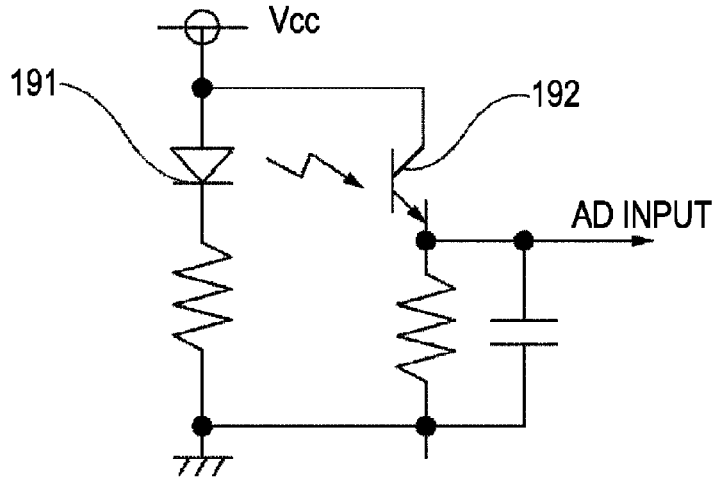
FIG. 12 is a circuit diagram of the photo interrupter shown in FIGS. 10 and 11.

FIG. 12 is a circuit diagram of the photo interrupter shown in FIGS. 10 and 11. Since the phototransistor 192 allows a current to flow in accordance with the amount of light received from the LED 191, the corresponding voltage is detected by AD input of a CPU 101. In the normal state, as shown in FIGS. 10 and 11, the actuator 193 supported by the fulcrum 194 hangs in the vertical direction due to the weight 193*a*. Therefore, the light from the LED 191 (the light emitting portion of the sensor) is blocked.

Figure 13:
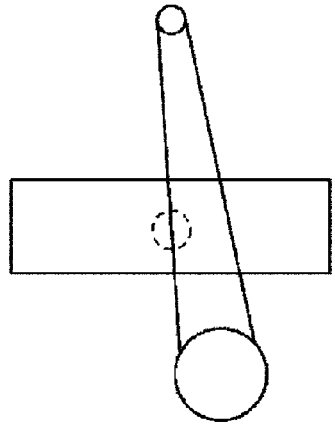
FIG. 13 illustrates an actuator when a small vibration is detected.
Figure 14:
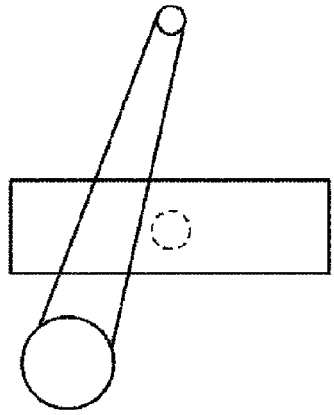
FIG. 14 illustrates the actuator when a large vibration is detected.

When a small vibration is detected, the actuator 193 is in the state shown in FIG. 13, only about half of the area of the phototransistor 192 can receive light, and therefore the phototransistor 192 receives the corresponding amount of LED light. In the case of a large vibration, the actuator 193 is in the state shown in FIG. 14, the phototransistor 192 (the light receiving portion of the sensor) is fully open, and therefore the phototransistor 192 can allow a larger amount of current to flow than in the state of FIG. 13.

Figure 17:
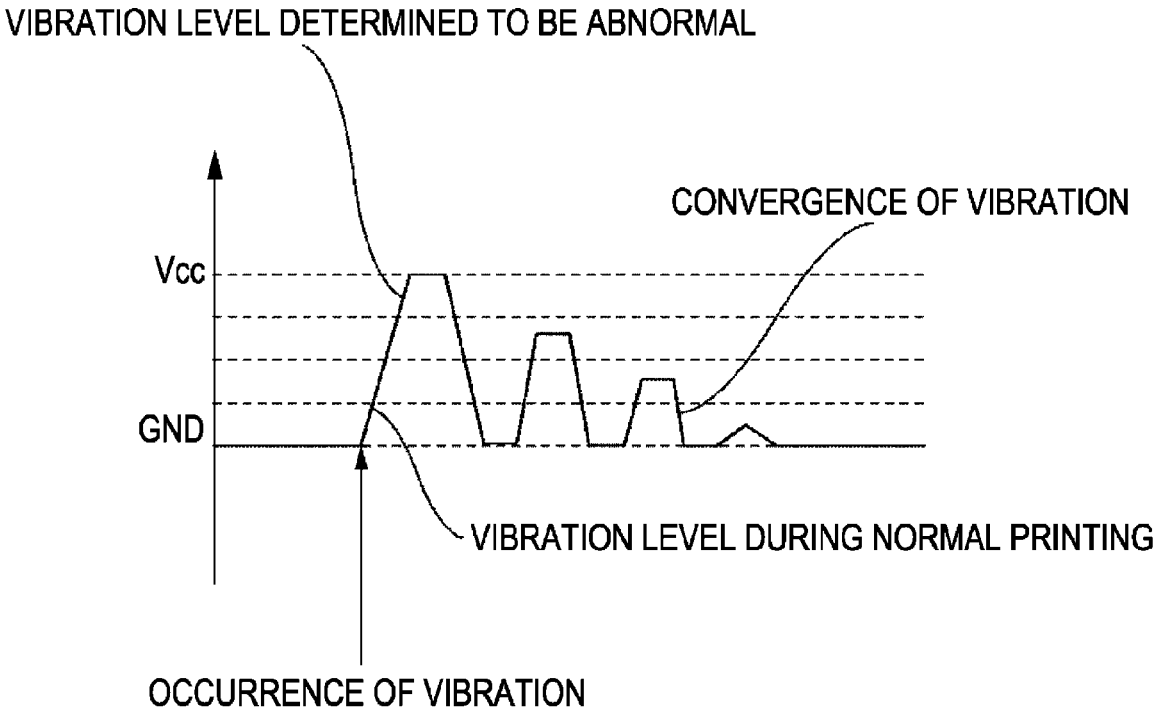
FIG. 17 illustrates changes in voltage of AD input from the occurrence to convergence of a vibration.

FIG. 17 illustrates changes in voltage of AD input from the occurrence to convergence of a vibration. As is clear from FIG. 17, the larger the vibration, the larger the amount of light received, and therefore the higher the voltage detected.

Correction of Image Forming Conditions by Vibration Detection

In this embodiment, if the vibration detecting unit detects a vibration at or above a predetermined vibration level (a reference vibration level as an abnormal vibration level) after a registration detection control is executed and before the next print signal comes, one more registration detection control is executed before the image formation.

For the concept of a problematic vibration (abnormal vibration), the reference vibration as an abnormal vibration is a value three times higher than the vibration level during a normal printing operation. If any vibration larger than this reference vibration is detected, one more registration correction is performed. Other than the vibration level during a normal printing operation, the abnormal vibration level may be set on the basis of a vibration when someone runs by the apparatus and a vibration level when the front door is closed.

In recent years, in 4D image forming apparatuses having a plurality of image bearing members, their image forming portions (10 in FIG. 1) have been increasingly cartridgized from the viewpoint of size reduction and maintainability. That is to say, photosensitive drums and developing units can be integrally attached to and detached from the apparatus. Since the cartridge (CRG) portion is not fixed to the body (ITB unit), for example, with screws, the positional relationship between the CRG and the ITB unit often deviates due to a vibration or shock, and color misregistration occurs. In this embodiment, the image forming apparatus is provided with a vibration detecting unit. If any vibration is detected after a registration detection control is executed and before the next print signal comes, a registration detection control is executed before the image formation in order to prevent possible color misregistration.

Figure 15:
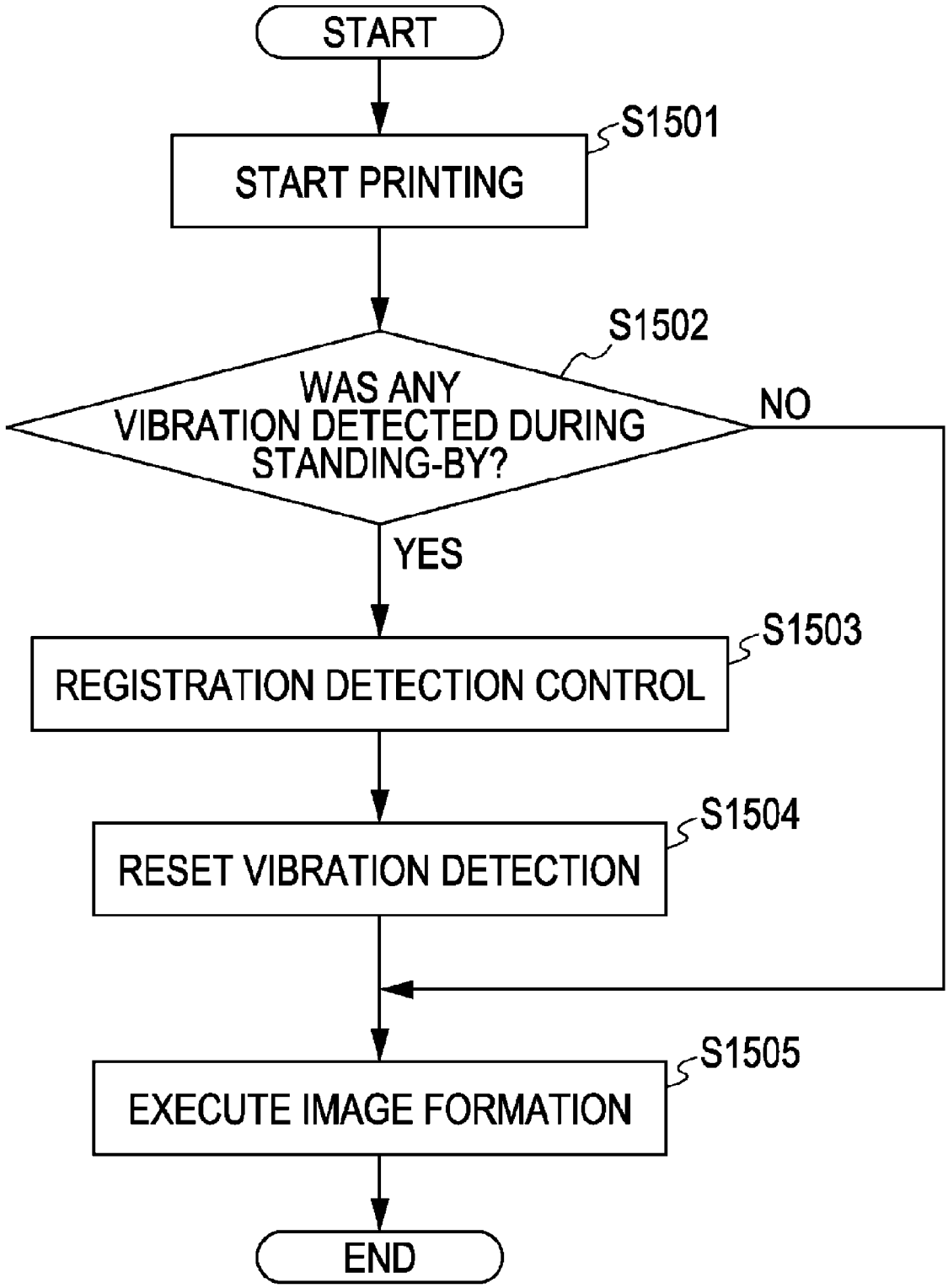
FIG. 15 is an operational flow chart of Embodiment 1.

FIG. 15 illustrates the operational flow according to an embodiment.

First, a print-start signal is received from the user (S1501). Next, it is determined whether a vibration at or above a defined level is detected within the image forming apparatus after the last registration detection control is executed and before the start of printing based on data associated with vibration detection stored in a ROM serving as a storage unit (S1502). If no vibration is detected (NO at step S1502), image formation is executed immediately (S1505). If a vibration at or above a defined level is detected (YES at step S1502), it is assumed that the vibration may have caused a deviation in registration, and a registration detection control is executed (S1503). When a registration detection control is executed, the data associated with vibration detection stored in the ROM is reset (S1504). Thereafter, the image formation is executed (S1505), and the operation is ended.

Executing the above control makes it possible to provide an image forming apparatus suitable for preventing the output of defective images without a user interaction even if the apparatus is vibrated during image formation or standing-by.

Although the image forming apparatus of an embodiment has an intermediate transfer member, the present invention is not limited to this.

The features of the present invention can also be applied to, for example, an apparatus that has a belt configured to bear and convey a transfer material and in which toner images are sequentially transferred from photosensitive drums directly onto the transfer material borne and conveyed by the belt. In this case, the toner images for detection are formed on the belt.

In an embodiment, whenever a vibration at or above the abnormal vibration level is detected, a registration correction is executed. However, the present invention is not limited to this. For example, an image forming apparatus may have a registration mode in which a registration correction is executed if an abnormal vibration is detected, the registration mode being selectable with a selecting unit. Only when the registration mode is selected, the registration correction is executed. When the registration mode is not selected, the image quality cannot be improved, but the printing time can be shortened.

Embodiment 2

In Embodiment 1, if a vibration at or above an abnormal vibration level is detected during the standing-by of the body, a registration detection control is executed before the next image formation. As for this embodiment, a control method in the case where any vibration was detected during a registration detection control will be described. The method of registration detection control and the method of vibration detection are the same as those in Embodiment 1. That is to say, if the vibration detecting unit detects any vibration after the control unit starts a registration detection control, one more registration detection control is executed after the vibration is detected and before the next image formation is performed. The term "to start a registration detection control" refers to "to start forming toner images for detection on the photosensitive drums by using the latent image forming units.

Figure 16:
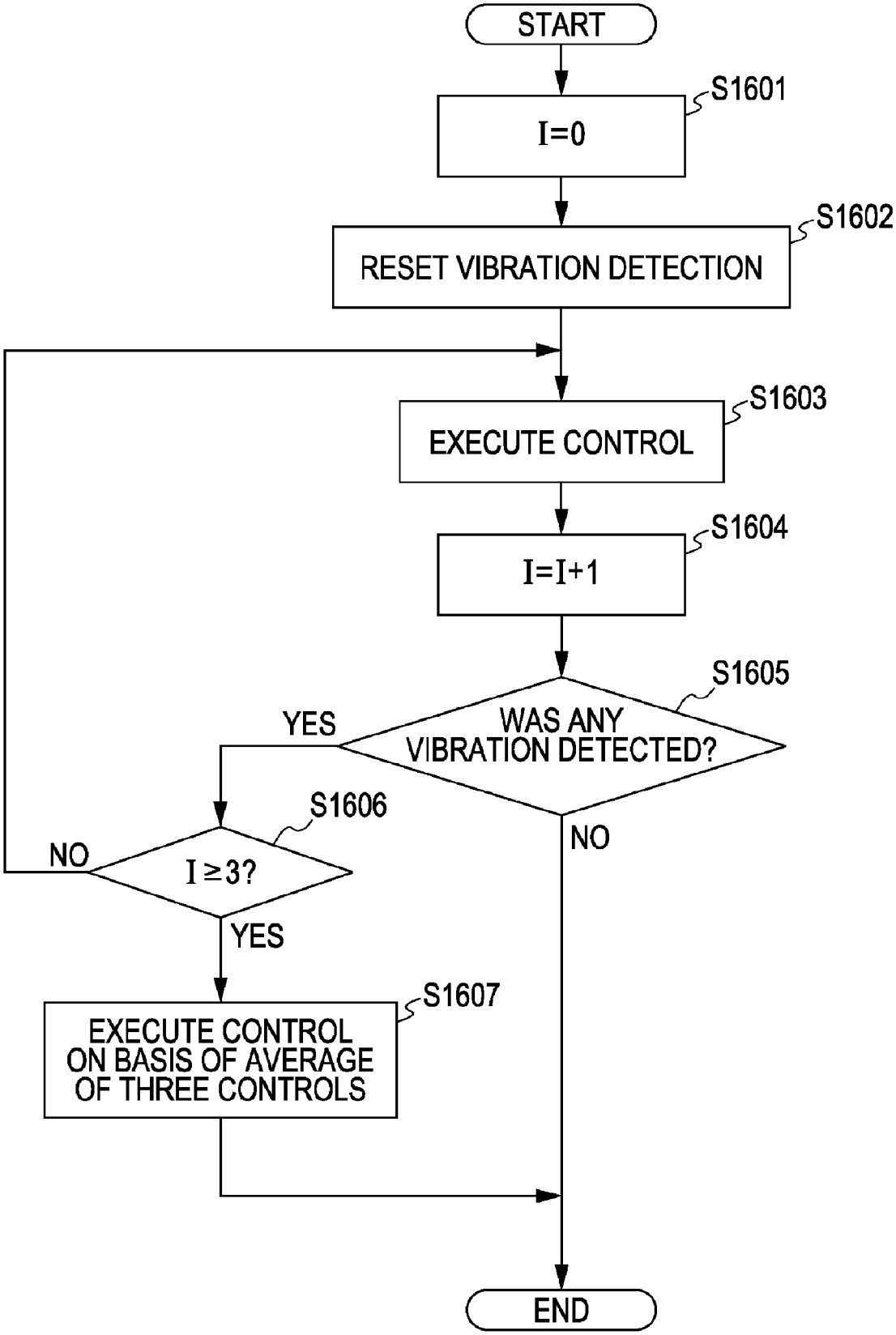
FIG. 16 is an operational flow chart of Embodiment 2.

FIG. 16 illustrates the operational flow in the case where a vibration is detected during a registration detection control. First, the number of registration detection controls is reset to zero (S1601 and S1602). Next, a registration detection control is executed (S1603). The number of registration detection controls is increased by one (S1604). Whether any vibration was detected during the registration detection control is determined (S1605). If no vibration was detected, the operation is ended. If any vibration was detected, the number of registration detection controls is determined (S1606). If the number is two or less, one more registration detection control is executed (S1603). If the number is three or more, it is determined that the body is still vibrating, and a registration detection control is executed on the basis of the average of the three controls (S1607).

In the above embodiments, the detecting unit detects registration patterns. However, the present invention is not limited to this.

The present invention can also be applied, for example, to the case where a vibration detecting unit detects any vibration after the control of image forming conditions is started in an image forming apparatus that forms a toner image for density detection, detects the density of the toner image, and thereby controls image forming conditions. That is to say, if the vibration detecting unit detects any vibration after the control of image forming conditions is started, the apparatus can be calibrated by forming a toner images for density detection and correcting image forming conditions so that a desired density can be obtained. In this case, image forming conditions can be controlled by controlling the exposing condition of the latent image forming unit, the charging condition of the charging unit, or the developing condition of the developing unit by using a control unit.

As described above, executing the above control makes it possible to provide an image forming apparatus suitable for preventing the output of defective images without being assisted by the user even if the apparatus is vibrated during image formation or standing-by.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-175566 filed Jun. 26, 2006, which is hereby incorporated by reference herein in its entirety.

What is claimed is:

1. An image forming apparatus comprising:

an image forming portion configured to form an image;

a correcting device configured to form a toner image for detection by using the image forming portion and to perform correction of image forming conditions based on the toner image for detection;

a vibration detecting device configured to detect a vibration of the image forming apparatus; and a setting device configured to selectively set a first mode in which the correcting device automatically performs a correction operation when the vibration detecting device detects a vibration of the image forming apparatus at or above a predetermined level or a second mode in which the correcting device does not perform the correcting operation even when the vibration detecting device detects a vibration of the image forming apparatus at or above the predetermined level.

2. The image forming apparatus according to claim 1, further comprising:

a storage unit configured to store detection results of the vibration detecting device after the vibration detecting device performs the correction operation lastly and before an image-forming-start signal is received; and an execution unit configured to execute the correction operation by the correcting device based on the image-forming-start signal and information stored in the storage unit.

3. The image forming apparatus according to claim 1, wherein in the first mode, the correcting device performs the correction operation again when the vibration detecting device detects a vibration of the image forming apparatus during the correction operation by the correcting device, and the correcting device performs the correction operation of image forming conditions based on detection result detected so far when the correcting device repeats the correction operation consecutively more than a predetermined number of times.

* * * * *